United States Patent [19]

Starling

[11] 4,208,762

[45] Jun. 24, 1980

[54] ROTATING COILER CLEANER

[75] Inventor: Bobby L. Starling, Charlotte, N.C.

[73] Assignee: Pneumafil Corporation, Charlotte, N.C.

[21] Appl. No.: 3,301

[22] Filed: Jan. 15, 1979

[51] Int. Cl.[2] ..... D01H 5/66

[52] U.S. Cl. ..... 15/312 R; 19/159 R; 19/263

[58] Field of Search ..... 15/301, 312 R; 19/159 R, 263

[56] References Cited

U.S. PATENT DOCUMENTS

| | | | |
|---|---|---|---|
| 3,020,600 | 2/1962 | West | 19/263 X |
| 3,287,768 | 11/1966 | Rakhorst | 19/263 X |
| 3,295,170 | 1/1967 | Whitehurst | 19/159 R X |
| 3,377,665 | 4/1968 | Kincaid | 19/159 R X |

*Primary Examiner*—Christopher K. Moore
*Attorney, Agent, or Firm*—Robert W. Fiddler

[57] ABSTRACT

Apparatus is disclosed for capturing lint, dust, fly and the like particulate matter released by the passage of sliver to the trumpet of an orbital sliver coiler utilizing an annular plenum arranged to surround the circumferential path of travel of the trumpet of the coiler. The plenum is formed with a stationary outer plenum section having an outlet connected to a suction hose, and a rotating inner plenum section formed with an inlet opening arranged adjacent and moving with the trumpet of the coiler. Air and particulate matter released by the sliver is drawn through the inlet opening into the plenum.

6 Claims, 2 Drawing Figures

ROTATING COILER CLEANER

BACKGROUND OF THE INVENTION

This invention relates to the art of coiler head cleaners, and more particularly to an improved apparatus for capturing lint, fly, dust and the like particulate matter released by the movement of the sliver into the trumpet of an orbital coiler, so as to minimize accumulations on the head of the coiler, thus reducing cleaning requirements, and further reducing entrainment of this particulate matter in the ambient textile mill atmosphere.

Sliver coilers have long been employed to coil the sliver produced by a cotton card into a sliver can to facilitate storage and transport of the formed sliver for subsequent processing. These coilers generally consist of a support for a cylindrical storage can, with a coiler head arranged above the top of the open can. These coiler heads are of a variety of types generally employing a trumpet through which the sliver from the card is fed. Relative rotation is produced between the trumpet and the can so as to effect coiling of the sliver passing through the trumpet in the can. In passing through the trumpet, the sliver as a result of the physical contact with the trumpet surfaces, and as a result of the change of direction of the sliver flow path releases varying quantities of lint, fly, dust and the like particulate matter. Some of this particulate matter accumulates on the coiler head requiring periodic cleaning, while a part of the particulate matter is entrained in the ambient mill atmosphere. Aside from increased production costs resulting from fiber loss and cleaning costs, the contamination of the mill atmosphere results in worker inefficiencies, and may often produce conditions violative of present working atmosphere standards as promulgated by OSHA.

BRIEF SUMMARY OF THE INVENTION

It is with the above considerations in mind that the present improved apparatus has been evolved for capturing lint, fly, dust and the like particulate matter released at the intake trumpet of an orbital sliver coiler, thus minimizing cleaning requirements at the coiler head, and reducing the entrainment of particulate matter in the ambient atmosphere.

It is accordingly among the primary objects of this invention to provide improved apparatus for capturing lint, dust, fly and the like particulate matter released during the passage of sliver into the trumpet of a sliver coiler.

A further object of the invention is to minimize the cleaning requirements for the heads of orbital sliver coilers.

Another object of the invention is to minimize the entrainment of particulate matter in the ambient atmosphere about orbital sliver coilers.

An additional object of the invention is to minimize fiber loss during coiling of sliver.

These and other objects of the invention which will become hereafter apparent are achieved by providing an annular plenum surrounding the circumferential path of travel of the trumpet of an orbital sliver coiler. The annular plenum is formed with a stationary outer section having an outlet connected to a suction hose, and a rotating inner section formed with an inlet opening adjacent and moving with the coiler trumpet. In the illustrated embodiment, the stationary outer section of the annular plenum is shown as having a cross-section in the form of a squared-off C, and the rotating inner section is formed in the shape of a right circular cylinder with a base having an opening to accommodate the sliver trumpet, and is mounted on the coiler gear case for rotation with the sliver trumpet. The cylinder wall of the rotating section closes the stationary outer annular plenum section, and is formed with an air inlet admitting opening adjacent the trumpet. The outer stationary plenum section is formed with a connector to a suction hose connection. In use, establishment of suction in the plenum creates an intake of air through the suction orifice over the coiler head from the vicinity of the trumpet.

A feature of the invention resides in the mounting of the apparatus so as not to interfere with the movement of the sliver into the trumpet while permitting ready viewing of the sliver.

Another feature of the invention resides in the fact that the rotating cover disc on a standard coiler can be replaced by the inner rotating section using the same locating and bolt holes.

BRIEF DESCRIPTION OF THE DRAWINGS

The particular details of the best mode contemplated by the inventor for carrying out the invention, and of the manner and process of making and using same so as to enable those skilled in the art to make and use same, will be described in full, clear, concise and exact terms in conjunction with the accompanying drawings, wherein.

DESCRIPTION OF PREFERRED EMBODIMENT

Figure 1:
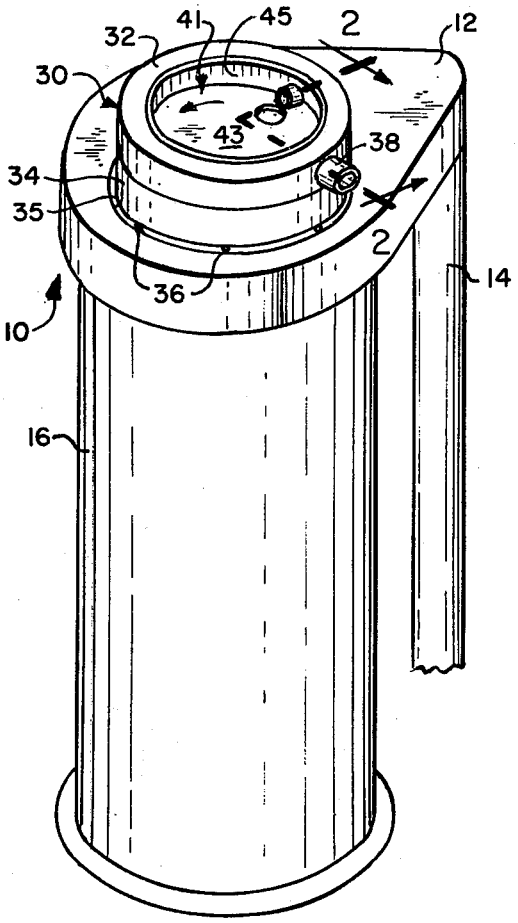
FIG. 1 is a perspective elevational view of an orbital coiler head with a sliver can shown in position, with the cleaning apparatus applied thereto.
Figure 2:
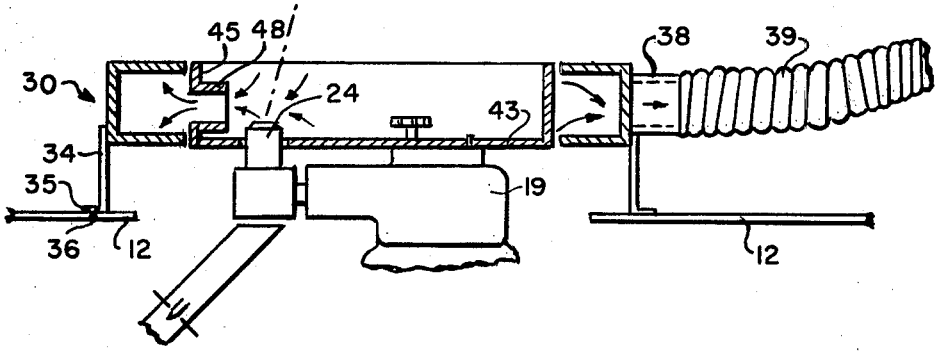
FIG. 2 is an enlarged cross-sectional view on line 2—2 of FIG. 1, showing the details of the cleaning apparatus.

Referring now more particularly to the drawings, where like numerals in the various FIGS. will be employed to designate like parts, as best seen in FIG. 1, a sliver coiler 10 is illustratively shown having a head 12 supported on a post 14 maintaining the head in position over cylindrical sliver can 16. As seen in FIG. 2, the coiler gear case 19 and trumpet 24 are supported for rotation above the sliver can 16. The illustrated structure in connection with which the invention is employed is a Crosrol planetary coiler, the details of which have only been described with such sufficiency as to provide support for the improved cleaning apparatus, it being understood that the inventive concept may be applied to a variety of other sliver coilers.

In accordance with the invention, an annular plenum 30 is provided having an inner diameter such as to permit installation of the plenum surrounding the circumferential path of the orbiting trumpet 24 of the coiler in connection with which the cleaner is employed. Annular plenum 30 is formed of a stationary outer section 32, illustratively shown as of a cross-section in the form of a squared-off C, with the vertical leg of the C lying on the outside of the plenum. This stationary outer section 32 is supported by a flanged ring support 34 on the coiler head 12. It will be observed that the outwardly extending flange 35 of the ring support 34 may be fastened by machine screws 36 or the like to the coiler head, while the upper vertically extending part of the ring support 34 may be attached also by machine screws to the stationary outer plenum section 32, or preferably the ring may be dimensioned for frictional engagement with the stationary outer plenum section 32. The hose connector 38 is extended from a discharge opening in the outer wall of stationary plenum section 32, and is coupled to a preferably flexible suction hose 39, as best seen in FIG. 2, the suction hose leading to an appropriate source of suction (not shown) such as the low pressure intake side of a fan, compressor, turbine or the like.

The rotating inner plenum section 41 is formed in the illustrated embodiment in the shape of a right circular cylinder open at the top and having a base 43 secured to the coiler gear case in place of the conventional rotating coiler disc. The upstanding side 45 of the cylinder is dimensioned to close-off the open inwardly facing side of the stationary outer plenum section 32, and is provided with a diameter such as to permit free rotation of the rotating inner section 41, but at the same time to provide relative enclosure of the annular space in the stationary outer plenum section 32. An opening is formed in base section 43 to accommodate trumpet 24, and a suction orifice 48 is formed on wall 45 adjacent trumpet 24.

OPERATION

In use, the cleaning assembly above described is fabricated, preferably by the utilization of conventional plastic forming techniques, with stationary outer plenum section 32 preferably formed by molding to provide a relatively C-shaped configuration, and with the inner cylindrically-shaped rotating plenum section 41 also formed either by molding or by conventional sheet plastic assembly techniques into the configuration shown.

It will be understood by those skilled in the art, that though the outer stationary plenum section 32 has been shown as of a C-shaped configuration, it may be formed of an L-shaped configuration with the illustrated upper flange of the plenum provided by a flange on the inner rotating cylindrical part within the scope of the invention, and that so long as the annular plenum shape is formed there is relatively little difference whether the horizontally illustrated walls of the plenum move or are stationary, so that they may be joined either to the vertically extending rotating cylindrical wall, or to the stationary outer wall.

After fabrication, as above described, the plenum sections are installed as illustrated and described, the inner rotating plenum section 41 replacing the rotating coiler plate, and the outer stationary plenum section 32 mounted on the head. Thereafter, appropriate connection is made to a suction source, and when the appropriate suction source is energized, so as to provide air flow through the trumpet suction orifice 48 into the stationary plenum 32 and then out through the suction hose to an appropriate collection or distribution point for the material entrained in the air stream established in the plenum.

The above disclosure has been given by way of illustration and elucidation, and not by way of limitation, and it is desired to protect all embodiments of the invention within the scope of the appended claims.

What is claimed is:

1. Apparatus for capturing lint, dust, fly and the like particulate matter released by the passage of sliver into the trumpet of an orbital coiler having a head and a trumpet supported for movement in a generally circular path about the head, said apparatus comprising: a plenum arranged adjacent the path of movement of the trumpet, said plenum having an annular fixed outer section with an air outlet, and a rotating inner section with an air inlet adjacent and moving with the trumpet, and a suction connection to the outlet of said outer plenum section.

2. Apparatus as in claim 1, in which the inlet into said rotating inner plenum section has a suction nozzle.

3. Apparatus as in claim 1, in which said fixed outer section has a cross-section in the shape of a squared-off C, and said rotating inner plenum section has a cylindrical wall closing off the open side of the C-shaped stationary plenum.

4. Apparatus as in claim 3, in which said rotating inner plenum section has a circular bottom wall with an opening through which the trumpet extends.

5. Apparatus as in claim 4, in which said circular bottom wall is fixed to the trumpet support in place of the conventional coiler trumpet disc.

6. Apparatus as in claim 3, in which a ring support is secured to the coiler head dimensioned to frictionally engage and support said stationary annular plenum section.

* * * * *